US005224223A

United States Patent [19]

Royal

[11] Patent Number: 5,224,223

[45] Date of Patent: Jul. 6, 1993

[54] DISPOSABLE INFLATABLE BEDPAN

[76] Inventor: Grace S. Royal, 12812 Lampton La., Ft. Washington, Md. 20744

[21] Appl. No.: 848,146

[22] Filed: Mar. 9, 1992

[51] Int. Cl.[5] ..... A61G 9/00

[52] U.S. Cl. ..... 4/451; 4/452; 4/456; 4/457

[58] Field of Search ..... 4/450, 451, 452, 453, 4/454, 455, 456, 457, 144.1, 144.2, 144.3, 144.4, DIG. 5; 604/329, 368, 369

[56] References Cited

U.S. PATENT DOCUMENTS

| | | | |
|---|---|---|---|
| 1,132,056 | 3/1915 | Wesley et al. | 4/455 |
| 3,464,066 | 9/1969 | Marks | 4/451 |
| 3,605,128 | 9/1971 | Oden et al. | 4/451 |
| 3,713,178 | 1/1973 | Mallette | 4/451 |
| 4,372,309 | 2/1983 | Fowler | 604/368 |

*Primary Examiner*—Henry J. Recla
*Assistant Examiner*—Robert A. Goldman
*Attorney, Agent, or Firm*—Stevens, Davis, Miller & Mosher

[57] ABSTRACT

The invention includes in part of a disposable. inflatable receptacle formed from a thermoplastic material, which when inflated can withstand compressive pressures, for body wastes of persons who are unable to use conventional bathroom facilities because they are confined to a bed due to illness or injury. The receptacle is larger than the conventional metal receptacle to provide more stability for a patient because of his bed confinement. The receptacle also provides improved positioning for the patient on the receptacle by the presence on at least two opposing sides of a rim surrounding the seating area. The receptacle has an upstanding portion on the front part of the seat which acts as a urinary shield. In a second form, the receptacle has a wedge-shaped rearward extension to support the back of a patient who cannot sit upon the receptacle but must use it from the prone position. The remaining part of the invention is a super absorbent pad inserted into the interior of the receptacle. The pad should contain an odor suppressant and preferably one which is activated by the presence of body liquid.

2 Claims, 4 Drawing Sheets

DISPOSABLE INFLATABLE BEDPAN

FIELD OF INVENTION

The present invention is in the field of accessories for persons who by accident or illness are at least temporarily bed confined. More specifically the invention relates to those accessories for handling the elimination of body wastes from such bed-confined persons.

BACKGROUND OF THE INVENTION

One of the biggest problems facing a hospital, be it civilian or military, or a military aid station in combat conditions, is the sterile, efficient and economical disposal of body waste of bedridden or non-ambulatory patients.

Presently, rigid bedpans fabricated from metal or other rigid materials are utilized to collect the wastes of nonambulatory patients. These bedpans are stored in a sterile area away from the wards and rooms where the patients are located. Thus, a hospital attendant must answer a patient's call, ascertain the need for a bedpan, go to the sterile storage area to secure the pan, take it back to the patient for use, return to the patient to remove the pan and then return the pan with the waste therein to a disposal area. After the bedpan is emptied, it must be completely sterilized before it can be resused.

Present sterilization techniques for rigid, reusable bedpans require the use of expensive equipment and a considerable amount of time. Likewise, when the pan is moved from area to area with the excrement stored therein, a cover, usually a paper bag or the like, is utilized to cover the bedpan during the move.

Obviously, an attendant wastes a considerable amount of time in the process of ascertaining the need for a bedpan, going to secure the pan and then returning the pan to a disposal area.

The present system of sterilization of rigid bedpans is not only costly in time and equipment required, but there is a serious doubt as to the ability to achieve 100% sterilization using existing equipment and methods, particularly in combat situations.

It must be understood that the problems of infection and reinfection in a base hospital, and most particularly in a MASH unit or a temporary combat unit holding facility for subsequent advanced medical facilities, are the most critical problems facing its staff. In some cases, if sterilization equipment breaks down or does not operate properly, infection of various types can rapidly spread throughout the hospital.

Of course, the use of a rigid, conventional bedpan is quite uncomfortable for a nonambulatory patient, particularly those patients who by age or disease have high pain sensitivity to having their pelvic region stressed by elevation or pressure or lack of sacro-support. In some instances, such patients will become irritable when an attendant does not promptly return at the patient's call to remove the pan. In some cases, continued use of conventional, rigid bedpans will cause aggravation of or formation of decubitus ulcers.

It will be obvious that the use of conventional bedpans in an environment such as, for instance, an army field hospital can never be absolutely sterile. That is, it would be entirely too burdensome to provide a field hospital with the equipment necessary to properly sterilize each bedpan after it is used.

Still another disadvantage of conventional bedpans is that, in their use, it is often difficult to keep the bedding clean. That is,the bedding is often contaminated by urine spatter when conventional bedpans are used. Of course, it is desirable to keep the bedding absolutely clean and dry.

Inflatable, disposable bedpans are well known in the art. See, for example, Oring U.S. Pat. Nos. 3,513,488; Dailey 3,605,127; Smith 4,207,633; Avoy 3,609,771; Yost 2,466,142; MacDonald 2,750,600; and Kimbro 3,728,744. Drawbacks associated with economy of production and practicality of use have resulted in the bedpans described in these issued patents being seldom used, if they are currently utilized at all.

One problem with many of the prior art bedpans is that they must be inflated before they are positioned beneath a bedridden patient. If the patient is paralyzed or experiences pain on movement onto the bedpan, the patient normally must have two or more attendants lift his hips high enough to allow the insertion of the bedpan under the buttocks or must have the attendants turn him to one side before placing the bedpan under the buttocks and then rotating him back to the supine position. Either of these procedures may cause extreme discomfort to patients who have fractures of the spine, pelvis, hips or upper legs and who experience pain during sudden or irregular movement. Paralyzed patients, many of whom may have accumulated considerable weight around the hip area, are difficult to lift onto a bedpan. More than one attendant is usually required and the attendants, each positioned on one side of the bed, must lean over the bed such that the muscles of their backs rather than their arm muscles are primarily used for lifting the patient; hence, attendants must possess considerable strength to successfully repeatedly raise a patient from the bed to insert or remove a bedpan. Nonambulatory patients who might be cared for at home are often placed in nursing homes largely because their familites are unable to cope with their toilet needs.

Further problems of existing inflatable bedpans are associated with the activation of self-contained mechanisms which provide the gas which inflates the plastic or other resilient material forming the inflatable chambers of the bedpan. U.S. Pat. No. 3,571,654 described in bedpan in which fluid is added to chemicals contained in the inflatable chamber of a bedpan. The reaction between the chemicals and water produces a gas which inflates the bed pan.

The problems arising from providing means for and comfort to bedridden persons in the elimination of bodily waste and to provide means to facilitate such have not been unrecognized. U.S. Pat. No. 3,546,717 discloses an inflatable single-use bedpan which is inflated from an oxygen supply. The so inflated bedpan has its body received wastes removed by rupturing the bottom wall over an appropriate waste receiving body. U.S. Pat. No. 3,579,654 discloses a self inflatable bedpan which so inflates by formation of a gas by the interaction of chemical components. U.S. Pat. No. 4,437,195 discloses a self-inflatable plastic bedpan which is activated by a pressurized gas cartridge contained within an adjunct integral with the inflatable portions of the bedpan. U.S. Pat. No. 3,513,488 discloses an oval bedpan having a valve for receiving pressurized gases or a self-generating gas system upon activation of a lever into a compartment in the disclosed unit. U.S. Pat. No. 3,464,066 discloses an inflatable disposable bedpan which has vertical ribs between the top and bottom compartments and which has a valved inlet/outlet means. The prior art has apparently not recognized the need to provide a bedpan which provides support for the lower back of a patient who, for reasons of illness or injury is unable to sit upon a bedpan.

SUMMARY OF THE INVENTION

The invention includes in part of a disposable, inflatable receptacle formed from a thermoplastic material, which when inflated can withstand compressive pressures, for body wastes of persons who are unable to use conventional bathroom facilities because they are confined to a bed due to illness or injury. The receptacle is larger than the conventional metal receptacle to provide more stability for a patient because of his bed confinement. The receptacle also provides improved positioning for the patient on the receptacle by the presence on at least two opposing sides of a rim surrounding the seating area. The receptacle has an upstanding portion on the front part of the seat which acts as a urinary shield. In a second form, the receptacle has a wedge-shaped rearward extension to support the back of a patient who cannot sit upon the receptacle but must use it from the prone position. The remaining part of the invention is a super absorbent pad inserted into the interior of the receptacle. The pad should contain an odor suppressant and preferably one which is activated by the presence of body liquid.

BRIEF DESCRIPTION OF THE DRAWINGS

The invention is illustratively shown in the accompanying drawings which are non-limiting in their disclosure.

DETAILED DESCRIPTION OF THE INVENTION

Figure 4:
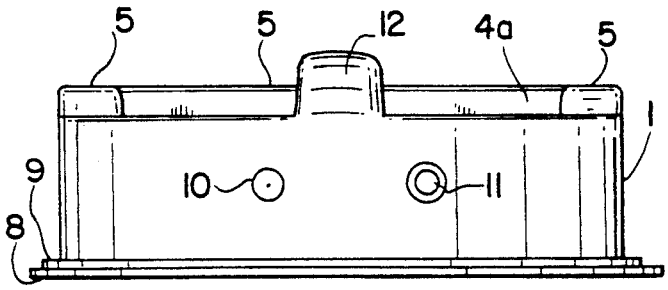
FIG. 4 is an elevation view of the front of FIG. 1.
Figure 1:
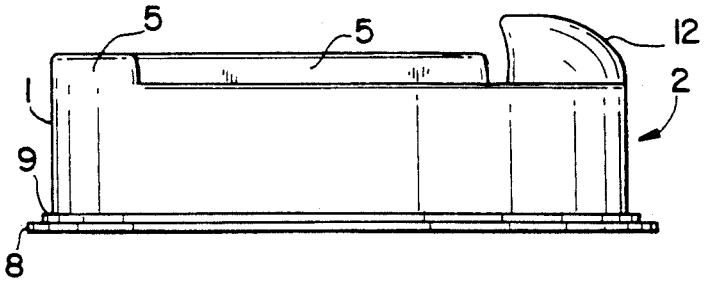
FIG. 1 is an elevation view of one side of one embodiment, the opposite side being substantially identical.
Figure 9:
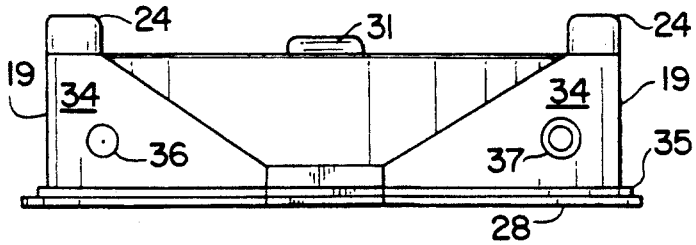
FIG. 9 is an elevation view of the back of FIG. 6.
Figure 6:
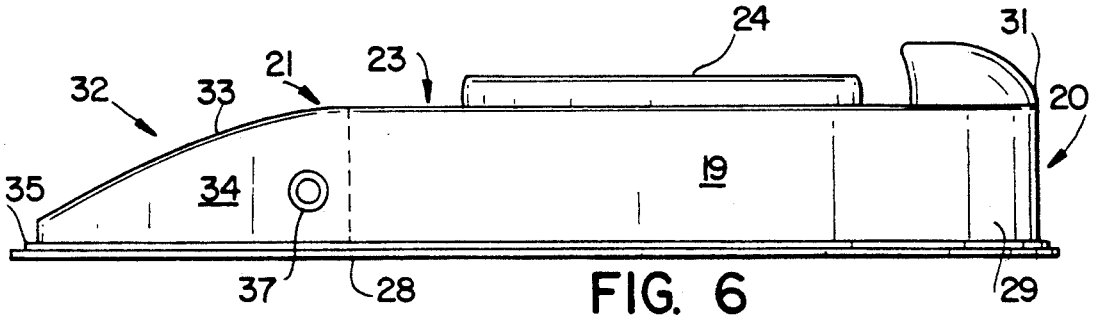
FIG. 6 is an elevation view of one side of the second embodiment, the opposite side being identical.
Figure 2:
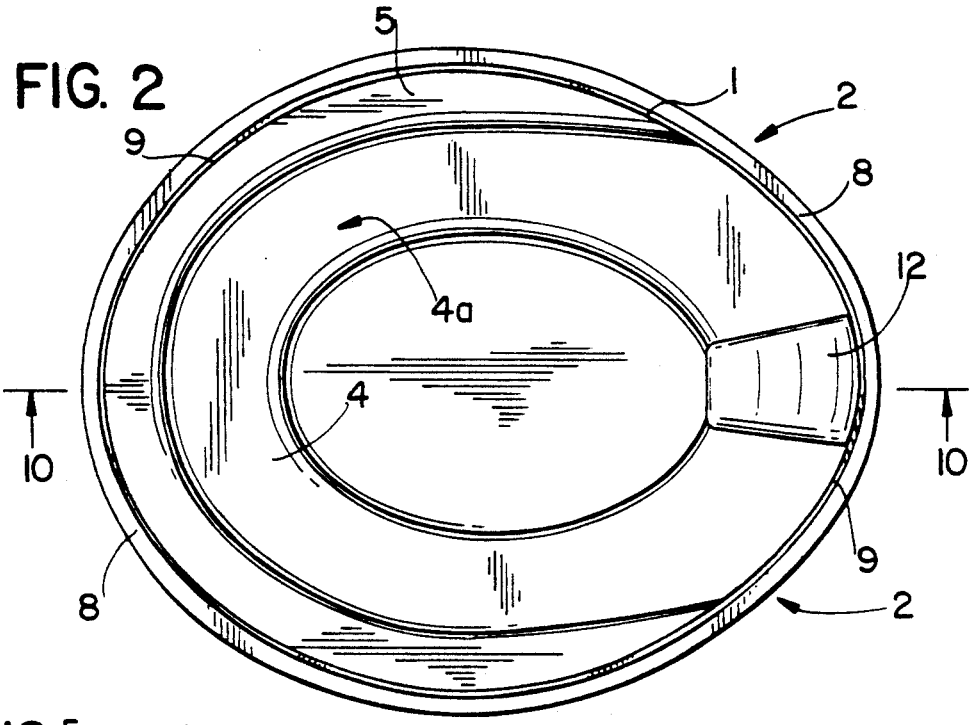
FIG. 2 is a top plan view of FIG. 1.
Figure 10:
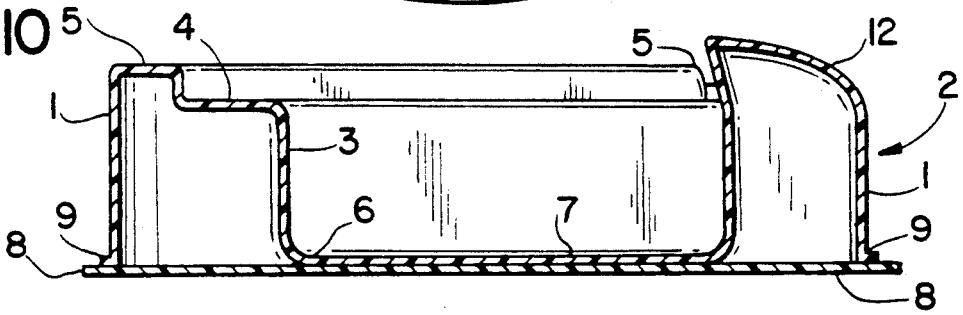
FIG. 10 is a cross-section view of FIG. 1 along the plane 10—10 in FIG. 2.
Figure 5:
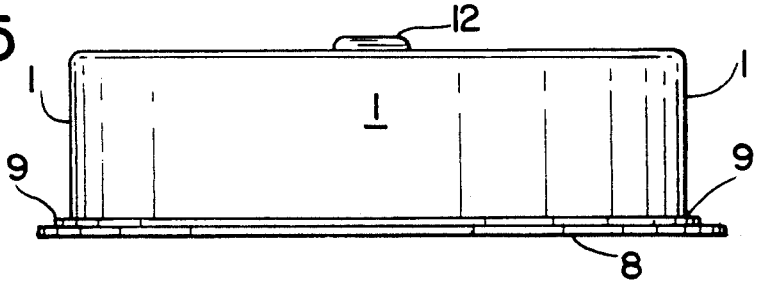
FIG. 5 is an elevation view of the back of FIG. 1.
Figure 3:
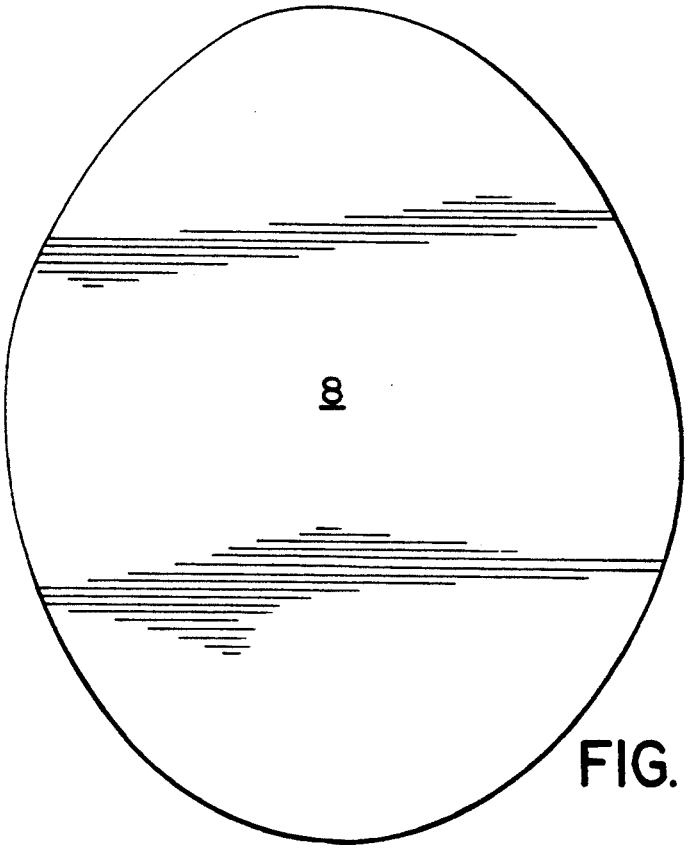
FIG. 3 is a bottom plan view of FIG. 1.

Referring to FIGS. 1-5 and FIG. 10, it will be seen that the invention is a bedpan shaped much like the seat for a conventional toilet. There is a outer side wall 1 which is of lesser height in the front portion 2. The inner side wall 3 is of uniform height, at the front portion 2, and is connected by a web 4 to the upper portion of side wall 1 to form a seating portion 4*a* and an upstanding ridge 5. The ridge 5 provides lateral support for the buttocks of the user. It will be noted that ridge 5 slopes down to the seat portion 4 in the front portion 2 to accommodate the thighs of the patient. It will also be seen that the lower edge 6 of inner side wall 3 is connected by a inner bottom wall 7. Outer bottom wall B is adhesively secured to the lower edge 9 of outer wall 1 and to the outer surface of inner bottom wall 7. This construction provides stability to the receptacle.

Inflation of the receptacle is accomplished by at least one inlet valve 10 which is preferably placed in the front portion as shown. Thus being between the legs of a user, the inflating gas can be more easily supplied to the valve 10. The inflating gas can be oxygen which usually has an outlet in each hospital room, or a portable tank of other compressed non-flammable gas. Depending upon the size of the receptacle and the user, it may be suitable to rely on cartridges of compressed gas of the type used with inflating buoyancy support vests. Deflation of the inflated receptacle prior to movement or removal of the user from the receptacle is not considered practical nor desirable under most conditions. However, the receptacle must be deflated for final disposal and for this purpose an exhaust valve 11 which can be manually operated is also positioned in the front portion 2. Valve 10 and valve 11 are of conventional well-known types and the size of the valve will be controlled by the size of the receptacle and the weight to be supported.

Another novel aspect of the invention is the forming of a urinary shield 12 on the surface of seating portion 4 at the time the walls 1 and 2 and inner bottom wall 7 are molded. The shield is a safeguard and does provide some screening.

Figure 11:
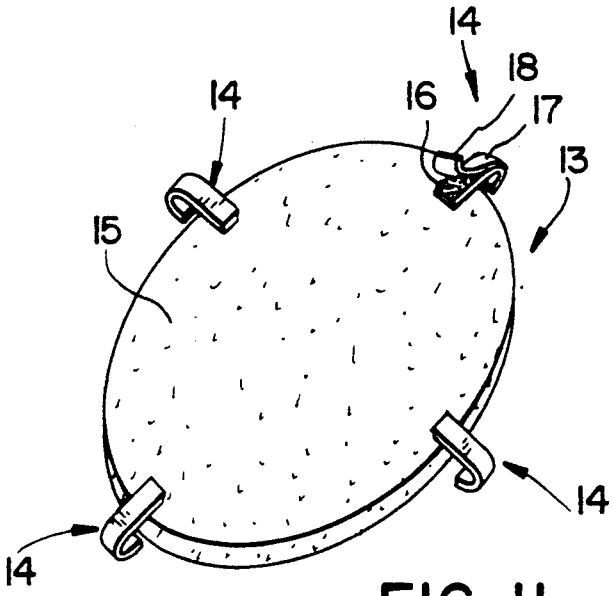
FIG. 11 is a perspective view of an absorbent pad for use with the invention.
Figure 7:
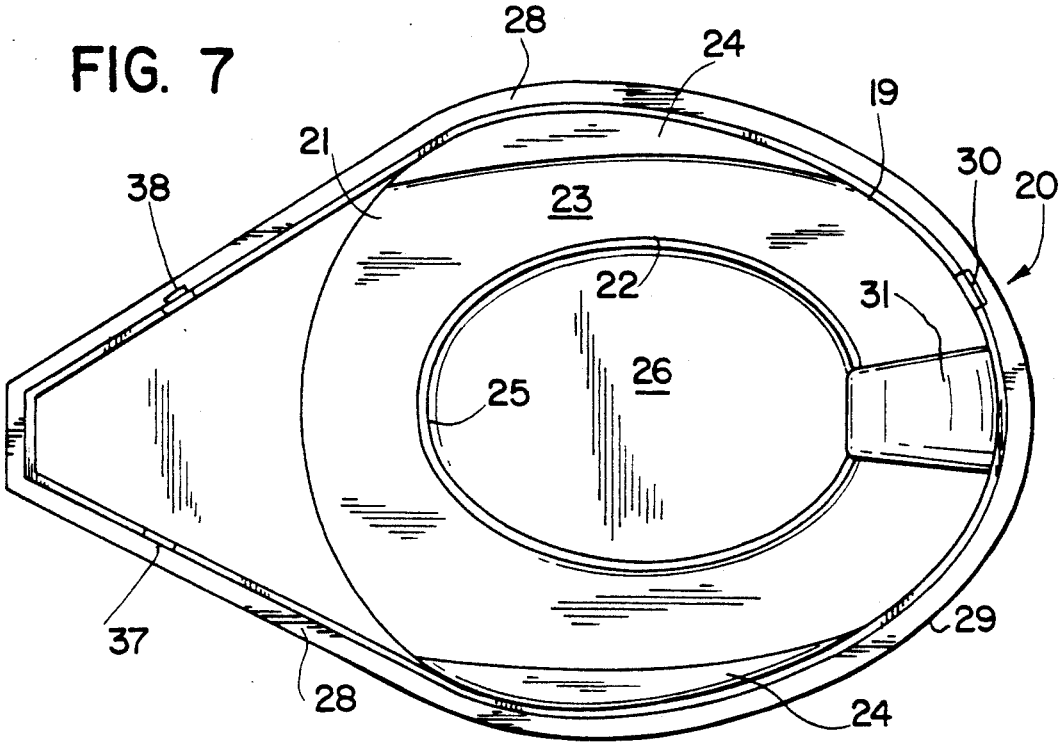
FIG. 7 is a top plan view of FIG. 6.
Figure 8:
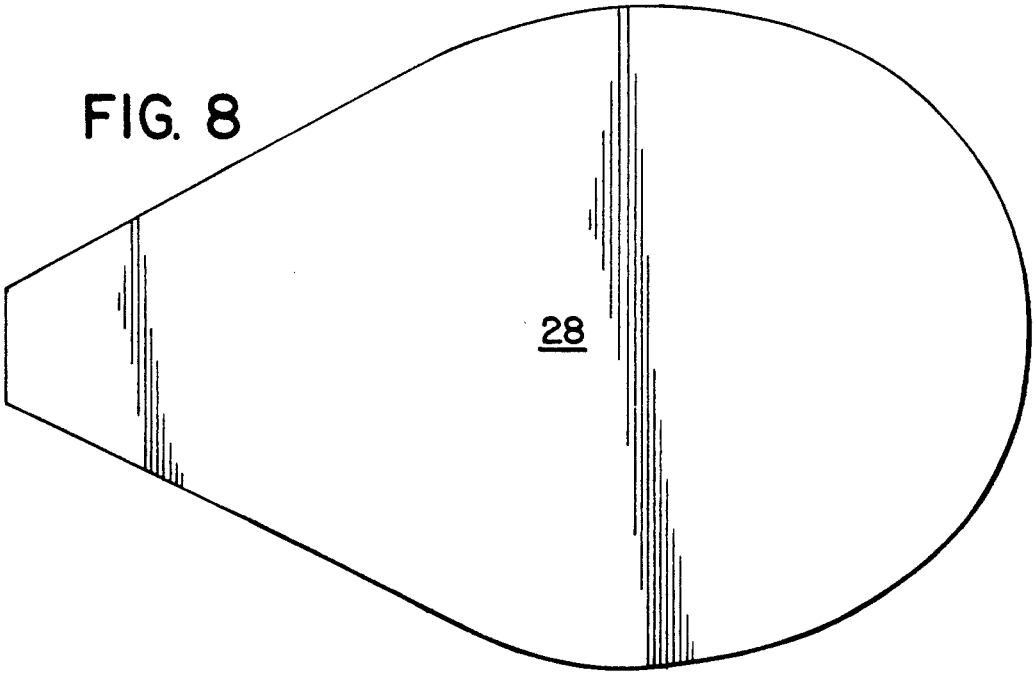
FIG. 8 is a bottom plan view of FIG. 6.

The absorbent pad 13 seen in FIG. 11 is employed with both embodiments of the invention. In substance it is substantially of the same construction as the super diapers currently available. It will be noted that there are four tabs 14 on the upper surface 15 of the pad. The tabs have an adhesive surface 16 which is protected by a releasable cover portion 17 which is removed so the tabs can be attached to the surface of inner wall 3 to hold the pad in place. Adhesive surface 16 is releasable from wall 3 by pulling upon cover end portion 18. This permits the pad and its contents to be removed and properly disposed of while the disposable bedpan is deflated and disposed of separately.

The embodiment seen in FIGS. 6-9 is primarily for the use of patients who are unable to sit up on a bedpan. As can be seen this embodiment has front and side portions substantially identical to the embodiment in FIGS. 1-5. There is an outer side wall 19 which is of lesser height in the front portion 20 and rear portion 21. The rear portion 21 accommodates the supine position of the lower back of the patient. As with the first embodiment, the inner side wall 22 is of uniform height, being equal to the height of front and back portions of outer side wall 19 which forms a seating portion 23 similar to seating portion 4. The difference in height of the outer side wall 19 and the inner side wall 22 in the mid-portion of the bedpan forms a lip 24 which functionly restrains any lateral movement of the patient on the bedpan. As with the first embodiment, the lower edges 25 of inner side wall 22 are connected by an inner bottom wall 26. The lower edges 27 of outer side wall 19 are adhesively joined to an outer bottom wall 28 which in turn is adhesively secured to inner bottom wall 26 to give stability to this embodiment. Inlet and outlet valves 29 and 30 are identical to counterparts in the first embodiment. As in the first embodiment, a urinary shield 31 is formed on the front on the bedpan.

The distinguishing feature of the second embodiment is the rearwardly extending wedge shaped rear portion 32 of the bedpan. This wedge shape 32 provides support to the sacroiliac portion and waist portion of a supine patient on this bedpan embodiment. The shape 32 has a upper surface 33 of a truncated triangle shape 33 extending rearwardly from seat portion 23. The side walls 34 of wedge 32 are considered to be triangular in form.

The bottom outer wall 28 extends from the bedpan per se to be joined to the edges 35 of side walls 34 and surface 33. Inflation of wedge shape 32 can be varied to provide the necessary support dictated by the body shape of the patient and to accommodate such variance inlet and outlet valves 36 and 37 are provided in one of the side walls 34.

The parameters of the present invention as shown in the drawings and described herein are illustrative only as to the principles of the invention and such changes as may occur to those of experience are considered to fall within the scope of the attendant claims.

What is claimed is:

1. An inflatable, disposable bedpan assembly comprising a bedpan of general oval configuration having, when inflated, a continuous vertical outer side wall having an upper and lower edge, a web extending inwardly from said upper edge of said outer side wall and defining an inner edge integral with a vertical inner side wall depending from said web inner edge and parallel to said outer wall, said web and respective side walls thereby forming a seating portion, said inner wall terminating with an inner bottom surface; said outer and inner walls, said web and said inner bottom surface all being formed from a single sheet of suitable thermoplastic material; the bedpan further having an inflatable urinary shield formed on said web; a portion of said outer wall having a height greater than the corresponding inner wall portion to form a rim to assist in positioning a patient on said bedpan, said rim terminating a spaced distance from both sides of said shield to leave segments of said assembly on either side of said shield with the heights of said inner and outer side walls the same, the assembly further having an outer bottom surface secured to said outer wall lower edge and to said inner bottom surface; and means in said outer wall for inflation and deflation of said bedpan.

2. The assembly according to claim 1 including an extension attached to a portion of the assembly extending rearwardly from the sides of said assembly in a wedge configuration tapering inwardly and downwardly with a truncated end to provide support for the back of a patient unable to sit up, said rim being formed on the sides of said assembly to assist stabilization of a supine patient, said outer bottom surface covering the wedge configuration.

* * * * *